US007489858B2

(12) United States Patent
Zank et al.

(10) Patent No.: US 7,489,858 B2
(45) Date of Patent: Feb. 10, 2009

(54) HEATER ASSEMBLY

(75) Inventors: Jeffrey T. Zank, Germantown, WI (US); Michael J. Martin, Sheboygan, WI (US); Michael A. Ward, Two Rivers, WI (US)

(73) Assignee: The Vollrath Company, L.L.C., Sheboygan, WI (US)

( * ) Notice: Subject to any disclaimer, the term of this patent is extended or adjusted under 35 U.S.C. 154(b) by 0 days.

(21) Appl. No.: 11/518,854

(22) Filed: Sep. 11, 2006

(65) Prior Publication Data

US 2008/0083727 A1 Apr. 10, 2008

(51) Int. Cl.
*A21B 2/00* (2006.01)
*F27B 5/14* (2006.01)

(52) U.S. Cl. ..... 392/416; 219/405; 219/411; 219/390; 392/418; 126/19 R; 126/273 R; 134/1; 99/451

(58) Field of Classification Search ..... 392/416, 392/419; 126/19 R, 273 R; 134/1; 219/405, 219/411; 99/451
See application file for complete search history.

(56) References Cited

U.S. PATENT DOCUMENTS 5,167,003 A * 11/1992 Montanari et al. ..... 392/416

OTHER PUBLICATIONS

The Vollrath Co., LLC, Smallwares & Light Equipment catalog, front cover, pp. 178, 188, 194-196, back cover, bearing a designation of "1999".

The Vollrath Co., LLC, Vollrath Smallwares + Light Equipment Catalog, front cover, pp. 1, 159, 170, 176-178, back cover, bearing a designation of "2001-2002".

Hatco Corporation, Glor-Ray infrared foodwarmers product specifications, models GRAH, GRH, GRA, GR, undated; 2 pages.

Hatco Corporation, Glor-Ray infrared foodwarmers product specifications, models GRAHL, GRAL, undated; 2 pages.

APW Wyott Foodservice Equipment Company, Standard Calrod Single Overhead Warmers product specification, bearing a designation of "Rev. Feb. 10, 2006"; 2 pages.

APW Wyott Foodservice Equipment Company, Standard Calrod Double Overhead Warmers product specification, bearing a designation of "Rev. Feb. 10, 2006", 2 pages.

* cited by examiner

*Primary Examiner*—Shawntina Fuqua
(74) *Attorney, Agent, or Firm*—Foley & Lardner LLP

(57) ABSTRACT

A heater is disclosed. The comprises a housing; a reflector; and a pair of opposite connectors supported by the reflector and configured to support opposite ends of a heating element. The reflector is movable between a plurality of positions relative to the housing.

31 Claims, 8 Drawing Sheets

HEATER ASSEMBLY

BACKGROUND

Heaters are used in a wide variety of applications to provide heat or warmth to an adjacent area. Heaters are commonly used to apply radiant heat to underlying food on a buffet table. Such heater assemblies typically comprise a housing an a heater unit. The heater unit typically includes a heating element and a reflector. Although such heaters have been used to heat food for years, such heaters have several disadvantages. For example, such known heaters have heating elements that are difficult to replace and have "hot spots" in their middle regions and cooler zone (project less heat) at the ends. Also, known heat elements are designed to have a heat pattern that is centered below the heating unit and are not easily adjustable. Further, such known heaters are not space efficient, are difficult to assemble/disassemble.

Accordingly, it would be advantageous to provide a heater assembly that has an adjustable heating unit and evenly dispenses a wide pattern of heat across its length. It would also be advantageous to provide a heater assembly that provides for easy replacement of the heating element and reduces or eliminates "hot spots". It would be desirable to provide for a heater assembly having one or more of these or other advantageous features. To provide an inexpensive, reliable, and widely adaptable heater assembly that avoids the above-referenced and other problems would represent a significant advance in the art.

SUMMARY

The present invention relates to a heater comprising a housing; a reflector; and a pair of opposite connectors supported by the reflector and configured to support opposite ends of a heating element. The reflector is movable between a plurality of positions relative to the housing.

The present invention also relates to a heater comprising a first housing; a reflector; and a first connector supported by the reflector and configured to removably receive a first end portion of a heater element while electrically connecting the end portion to both a power source and to ground.

The present invention further relates to a heater comprising: a housing; a reflector movable between a plurality of discrete positions relative to the housing; a heating element having a first portion configured to provide a first heat energy level and at least one second portion configured to provide a second heat energy level less than the first portion; and a first connector supported by the reflector and configured to removably receive a first end portion of the heater element while electrically connecting the end portion to both a power source and to ground.

The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

DETAILED DESCRIPTION OF PREFERRED AND EXEMPLARY EMBODIMENTS

Figure 1:
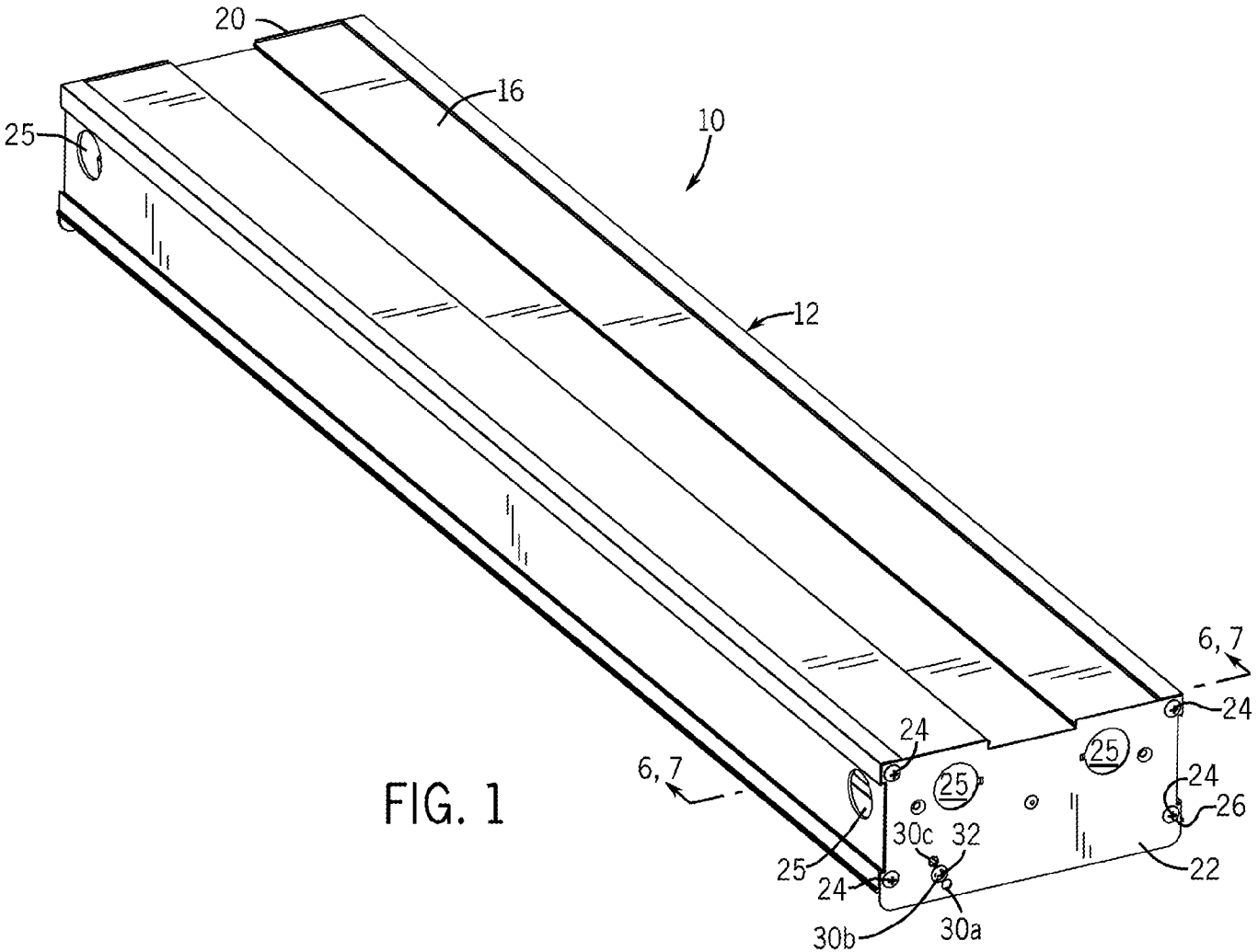
FIG. 1 is an isometric view of a heater according to an exemplary embodiment.
Figure 2:
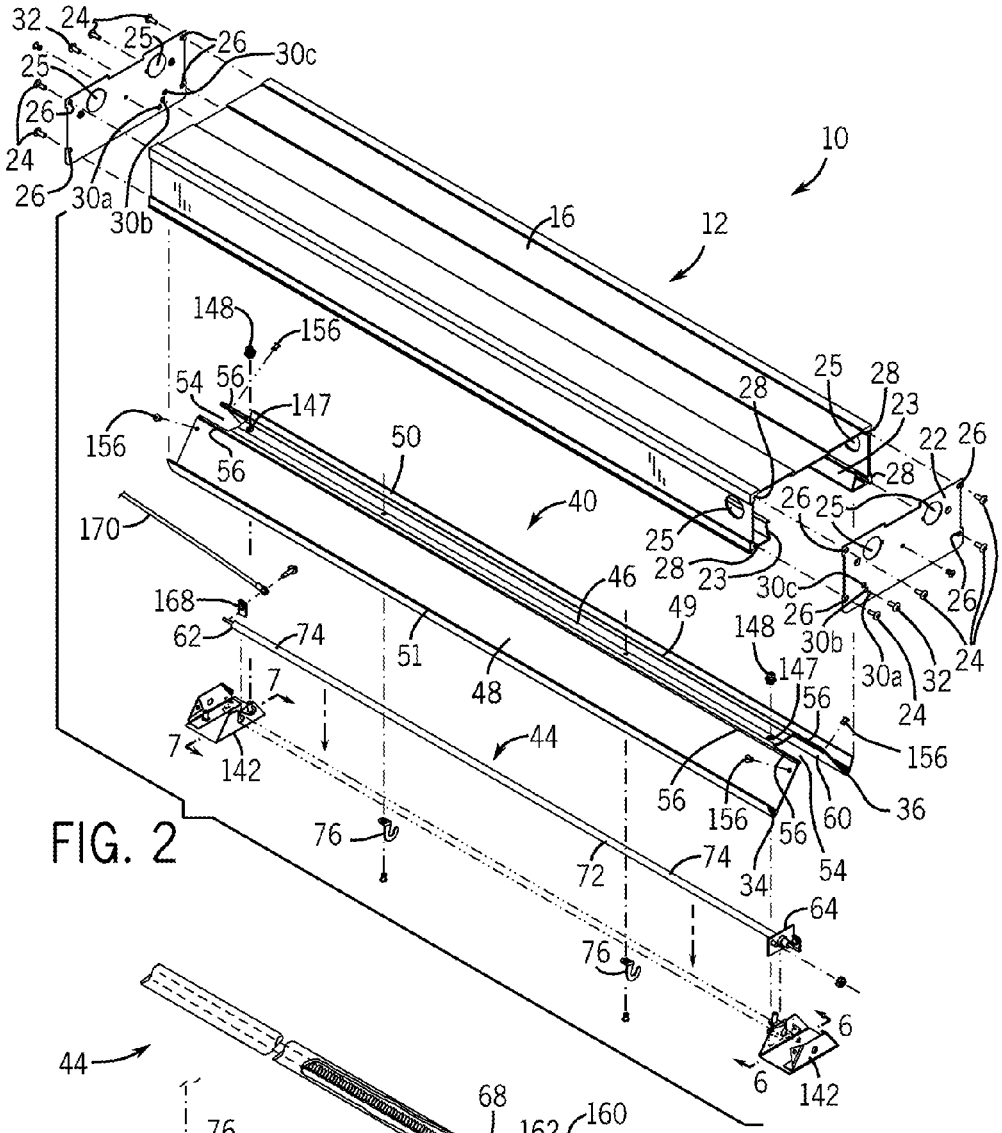
FIG. 2 is an exploded view of the heater in FIG. 1.

FIGS. 1 and 2 illustrate heater 10. FIG. 1 is a top isometric view of heater 10. FIG. 2 is a top exploded isometric view of heater 10. Heater is configured to provide adjustable heating direction that is uniform across its length and is easy to assembly and disassemble. As best shown by FIG. 2, heater 10 includes housing 12 and heating unit 14.

Housing 12 comprises one or more structures configured to support heating unit 14 in at least one position relative to the adjacent area to be heated. In the particular embodiment illustrated, housing 12 is configured to support heating unit 14 in a plurality of different positions so as direct heat to different areas. In the example of housing 12 that is shown, housing 12 includes main body 16, and ends 20, 22.

Main body 16 serves as a main support for heating unit 14 and generally receives heating unit 14. Main body 16 further provides an electrical raceway for enclosing wiring between heating unit 14 and main body 16. In one embodiment, main body 16 is an elongate extruded structure having a uniform cross-sectional shape along its axial length. As a result, main body 16 is easy and inexpensive to manufacture. In one embodiment, main body 16 is formed from aluminum. In other embodiments, main body 16 may be formed using other manufacturing techniques and one or more other materials.

Ends 20, 22 comprise structures (e.g., plates, panels, members etc.) configured to cap axial openings of main body 16. Ends 20 and 22 are configured to be releasably connected to main body 16 by fasteners 24 which pass through openings 26 and into axially extending bores 28 of main body 16. In other embodiments, ends 20, 22 may alternatively be configured to be releasably coupled to main body 16 by other fasteners, by snap mechanisms such as a resilient hook extending from one of ends 20, 22 and main body 16 which engages the corresponding detent provided on the other of ends 20, 22 and main body 16, or by other removable attachment techniques. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

As further shown by FIG. 2, each of ends 20, 22 additionally includes openings 30*a*, 30*b* and 30*c*. Openings 30*a*, 30*b* and 30*c* extend through ends 20 and 22 at locations corresponding to positions at which heating unit 14 is to be retained relative to housing 12. Each of openings 30*a*, 30*b* and 30*c* is configured to enable retainers 32 to pass through one of openings 30*a*, 30*b* and 30*c* into engagement with heating unit 14 so as to secure heating unit 14 to ends 20, 22 in a desired orientation.

In the particular embodiment illustrated, each of retainers 32 extends through an associated end 20, 22 into engagement with one of axial bores 34, 36 of heating unit 14. In the particular embodiment illustrated, retainers 32 comprise grooves which self thread into bores 34 and 36. In an alternative embodiment, bores 34 and 36 may be pre-threaded before engagement with retainers 32. Because retainers 32 retain heating unit 14 in place by engagement with axial bores 34 and 36, holes or apertures do not need to be formed through portions of heating unit 14 which reflect heat or which are visible upon a final assembly of heater 10. Moreover, this further enables portions of heating unit 14 to have a uniform cross-sectional shape along its entire axial length, enabling portions of heating unit 14 to be extruded. Assembly is further simplified in that additional openings or bores do not need to be formed by removing material from portions of heating unit 14.

Although both of ends 20, 22 are illustrated as including openings 30*a*, 30*b* and 30*c*, housing 12 may alternatively be configured such that only one of ends 20, 22 includes openings 30*a*, 30*b* and 30*c*. In still other embodiments, one of ends 20, 22 may include a portion of openings 30*a*, 30*b* and 30*c* while the other of ends 20, 22 includes the remaining portion of openings 30*a*, 30*b* and 30*c*. Although ends 20 and 22 are illustrated as including three distinct openings corresponding to three distinct potential positions of heating unit 14, ends 20, 22 may alternatively have a fewer or greater number of such openings. According to exemplary embodiments, other and/or additional openings with a variety of spacing/distribution may be provided to provided other desired adjustability. In lieu of comprising distinct apertures, openings 30*a*, 30*b* and 30*c* may alternatively comprise elongate slots, enabling heating unit 14 to be selectively positioned at one of a continuum of different positions along each slot by repositioning retainer 32 within each slot. For example, in one embodiment, openings 30*b* and 30*c* may alternatively each comprise a slot or may be both replaced with a single slot. In still other embodiments, other retainers and other retaining mechanisms may be employed to selectively secure heating unit 14 in one of a plurality of positions relative to housing 12. In still other embodiments, ends 20, 22 may alternatively be configured to retain heating unit 14 in only a single position relative to main body 16 and housing 12.

As shown by FIG. 2, main body 16 includes inner flanges 23. Inner flanges 23 extend along the axial length of main body 16 within an interior of main body 16 opposite to one another. Inner flanges 23 cooperate with heating unit 14 so as to prevent air flow or heat from passing between heating unit 14 and inner flanges 23. Inner flanges 23 further assist in concealing and shielding any electrical wiring between main body 16 and heating unit 14. In other embodiments, inner flanges 23 may be omitted.

In the particular embodiment illustrated, main body 16 is integrally formed as a single unitary body. In other embodiments, main body 16 may be formed from multiple structures which are welded, bonded or adhered to one another. In the particular embodiment illustrated, main body 16 is extruded. In other embodiments, main body 16 may be formed from deformed sheet metal, may be molded, may be cast or may be formed by other manufacturing techniques or other materials.

Figure 3:
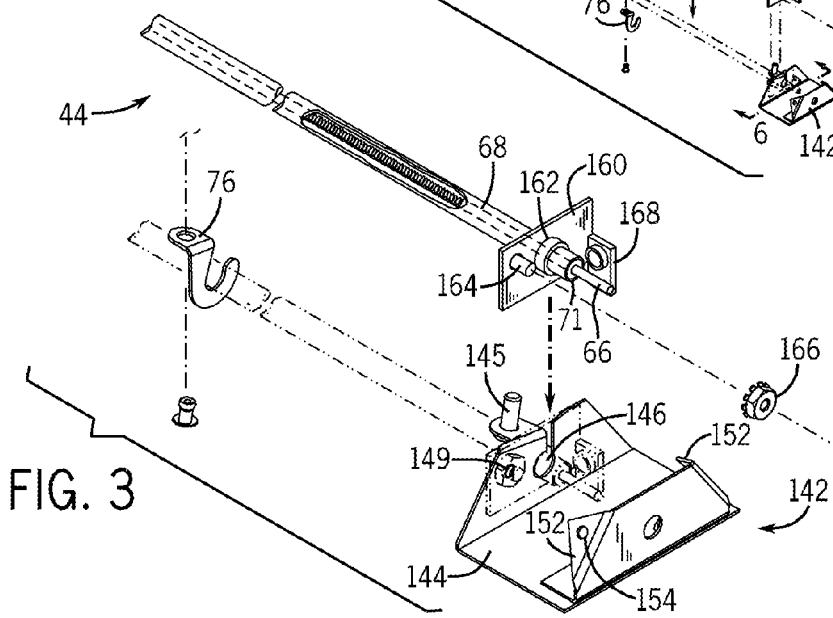
FIG. 3 is a close-up exploded view of one of the connectors in FIG. 2.

As shown by FIG. 2, heating unit 14 includes reflector 40, connectors 142 and heating element 44. FIG. 3 is a top perspective view illustrating an assembled heating unit 14.

Reflector 40 is positioned and designed to widen the heat pattern radiated (projected, dispensed, etc.) from heating unit 14. Reflector 40 comprises an elongate member configured to extend opposite to heating element 44 so as to reflect heat emitted by heating element 44. Reflector 40 generally includes spine 46, wings 48, 49 and wingtips 50, 51. Spine 46 generally functions as a backbone of reflector 40 and extends parallel to heating element 44. Wings 48 and 49 obliquely extend from spine 46 and cooperate with spine 46 to provide a majority of a reflecting surface 60 about heating element 44. Wingtips 50, 51 extend from wings 48 and 49, respectively, and are configured to cooperate with flanges 23 of main body 16 and housing 12 to cover and conceal the volume between reflector 40 and main body 16. Elongate bores 34 and 36 are formed along a junction of wing 48 and wingtip 50 and along a junction of wing 48 and wingtip 50, respectively. One of bores 34 or 36 are configured to align with holes 30*a*, 30*b*, and 30*c* depending on the orientation of ends 20 and 22 coupled to main body 16.

In the particular embodiment shown, spine 46, wings 48, 49 and wingtips 50, 51 are integrally formed as a single unitary body out of a metal such as aluminum. In the embodiment shown, reflector 40 has a uniform cross-section (but for openings 54 which are cut) along its entire axial length, enabling reflector 40 to be formed using an extrusion process. In alternative embodiments, reflector 40 may be formed from other materials, may be formed from individual structures which are welded, bonded, fastened or otherwise connected to one another, or may be formed from one or more different manufacturing techniques. According to an exemplary embodiment, reflector has a shiny or glossy surface that reflects heat energy. According to a particularly preferred embodiment, the reflector is bright-anodized to inhibit or prevent it from darkening or tarnishing or otherwise degrade over time.

Hooks or brackets 76 are coupled (e.g., riveted as shown or otherwise) to spine 46 of reflector 40. Hooks 76 are configured to help support heating element 44 and suspend heating element between the wings 48 and 49 of reflector 40. According to an exemplary embodiment, hooks 76 are generally thin-bodied J-shaped elements that partially surround heating element 44. Heating element 44 is inserted from the top and rests upon hooks 76. According to other exemplary embodiments, hooks 76 may have a rounded cross-section or may be configured to surround heating element completely. According to such an embodiment, heating element would be inserted from the side and slid into apertures formed by hooks 76.

Connectors 142 are coupled to opposite axial ends of spine 46 of reflector 40. Connectors 142 comprise structures configured to at least partially support heating element 44 such that heating element 44 is partially surrounded by reflective surface 60 provided by spine 46 and wings 48, 49. In the embodiment shown, connectors 142 are supported solely by reflector 40 such that connectors 142 are part of heating unit 14 which may be separated by housing 12 and such that, in embodiments wherein heating unit 14 moves between different positions relative to housing 12, connectors 142 also move with heating unit 14. As will be described in greater detail hereafter with regard to FIG. 12, in one particular embodiment, connectors 42 are configured to removably receive end portions of heating element 44 while electrically connecting the end portions to a power source with wires 170. As a result, heating element 44 may be quickly and easily removed from heating unit 14 and from heater 10 for repair, replacement or inspection.

As shown in FIG. 3, connector 142 includes a base 144, a shield or guard 150, and a plate 160. Base 144 forms the main body of connector 142 and is a generally thin-walled L-shaped bracket. Base 144 has a slot or opening 146 that is configured to receive at least a portion of heating element 44. Base 144 further includes a threaded member (shown as a rod or post 145) that extends upward from base 144. Threaded post 145 is received by a hole 147 in reflector 40. A nut 148 threadably engages post 145, trapping reflector 40 between nut 148 and base 144 and coupling connector 142 to reflector 40. Shield 150 is configured to at least partially close off one side of connector 142 and restrict access to the interior of connector when heating unit 14 is assembled (e.g., to reduce the risk of electrical shock). Shield 150 is coupled to an end of base 144. According to an exemplary embodiment, shield 150 includes to flanges or ears 152. Ears 152 have holes 154 and provide a surface to couple connector 142 to reflector 40 using fasteners 156. Shield further includes one or more holes 158 that are configured to allow wires 170 to pass through shield 150. Plate 160 (e.g., panel, member, etc.) includes a hole or aperture 162 that is configured to receive heating element 44. Plate 160 further includes a threaded post 164 that extends outward from the surface of plate 160. Heating element 44 is inserted through aperture 162 in plate and may be coupled to plate 160 (e.g., with an interference fit). Plate 160 is coupled to base 144 by inserting post 164 into a hole 149 in base and threading a nut 166 onto post 164. When plate 160 is coupled to base 144, heating element 44 passes through opening 146 in base 144. A terminal 168 is coupled to heating element 44 (e.g., by welding) and facilitates the coupling of wires 170 to heating element 44.

Figure 4:
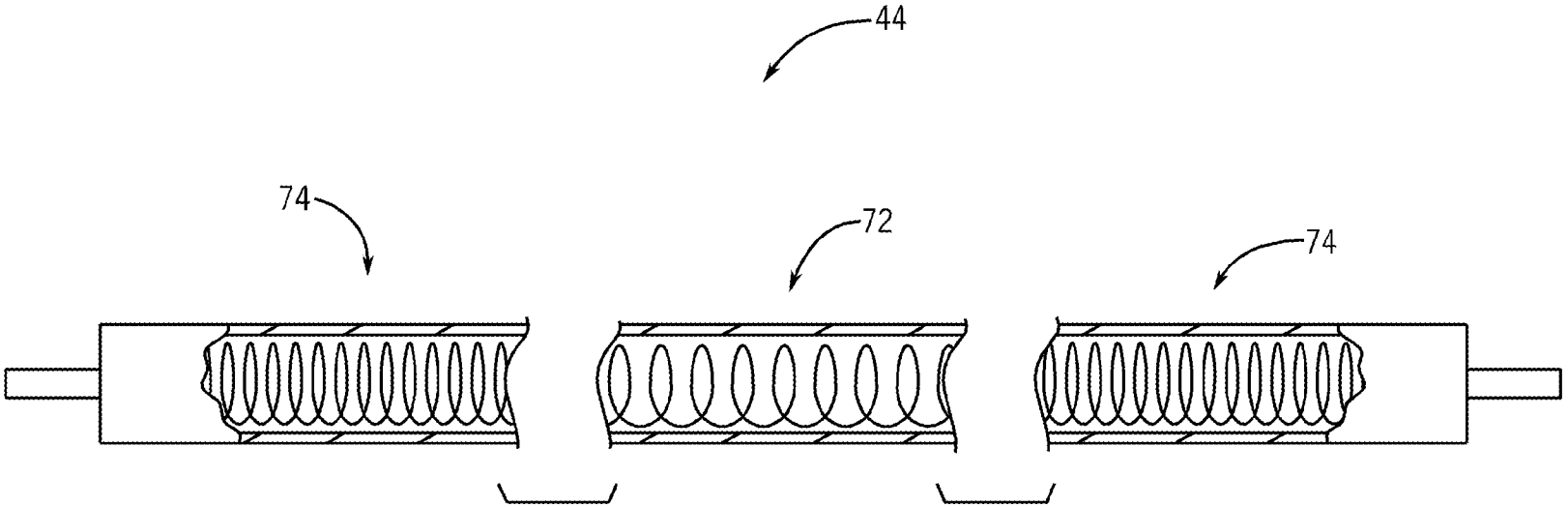
FIG. 4 is a partial broken view of the heating element in FIG. 1 illustrating the difference in coil density in different parts of the heating element.

Referring to FIGS. 2-4, heating element 44 comprises an elongate member configured to emit heat upon being energized. Heating element 44 has opposite axial ends 62, 64 which are coupled to connectors 142 to suspend heating element 44 relative to reflector 40. In the particular embodiment shown, heating element 44 comprises a tubular electrical resistance heating element commonly referred to as CALROD by General Electric. In such an embodiment, heating element 44 includes an axially extending central rod 66 and an outer layer or portion 68 which form a shoulder 71. Heating element 44 includes a central portion 72 and two outer portions 74. Heating element 44 is configured so that the wattage density per inch changes gradually from a first wattage density generally in central portion 72 to a second wattage density per inch in the outer portions 74 such that the second wattage density is higher than the first wattage density. As shown in FIG. 4 and according to an exemplary embodiment, this is accomplished by varying the number of wire coils per inch in heating element 44. Typical heating elements have a generally constant wattage density per inch and produce more heat in the center than at the ends. Such variable/varying heat dispensing is intended to reduce or eliminate "hot spots" and dispense more heat at the ends of heating element 44 and less at the center of heating element 44 to compensate for the naturally occurring heat dispensation at the ends and to provide a wider heated zone (particularly when heating units are coupled or ganged together as discussed further below). Because the wattage density per inch is variable in heating element 44, heating element 44 is able to produce a more even heat along its length than typical heating elements. Although heating element 44 is illustrated as comprising a CALROD element, heating element 44 may alternatively comprise other members configured to emit radiant heat. In particular embodiments, heating element 44 may additionally be configured to emit light.

An electrical coupling may be provided comprising a structure configured to secure electrical wiring relative to housing 12. In the particular example shown, the electrical coupling is configured to clamp about such electrical wiring and may be mounted to housing 12 at various locations provided by openings 25 formed in either main body 16 or ends 20, 22. When not in use openings 25 are closed.

Figure 5:
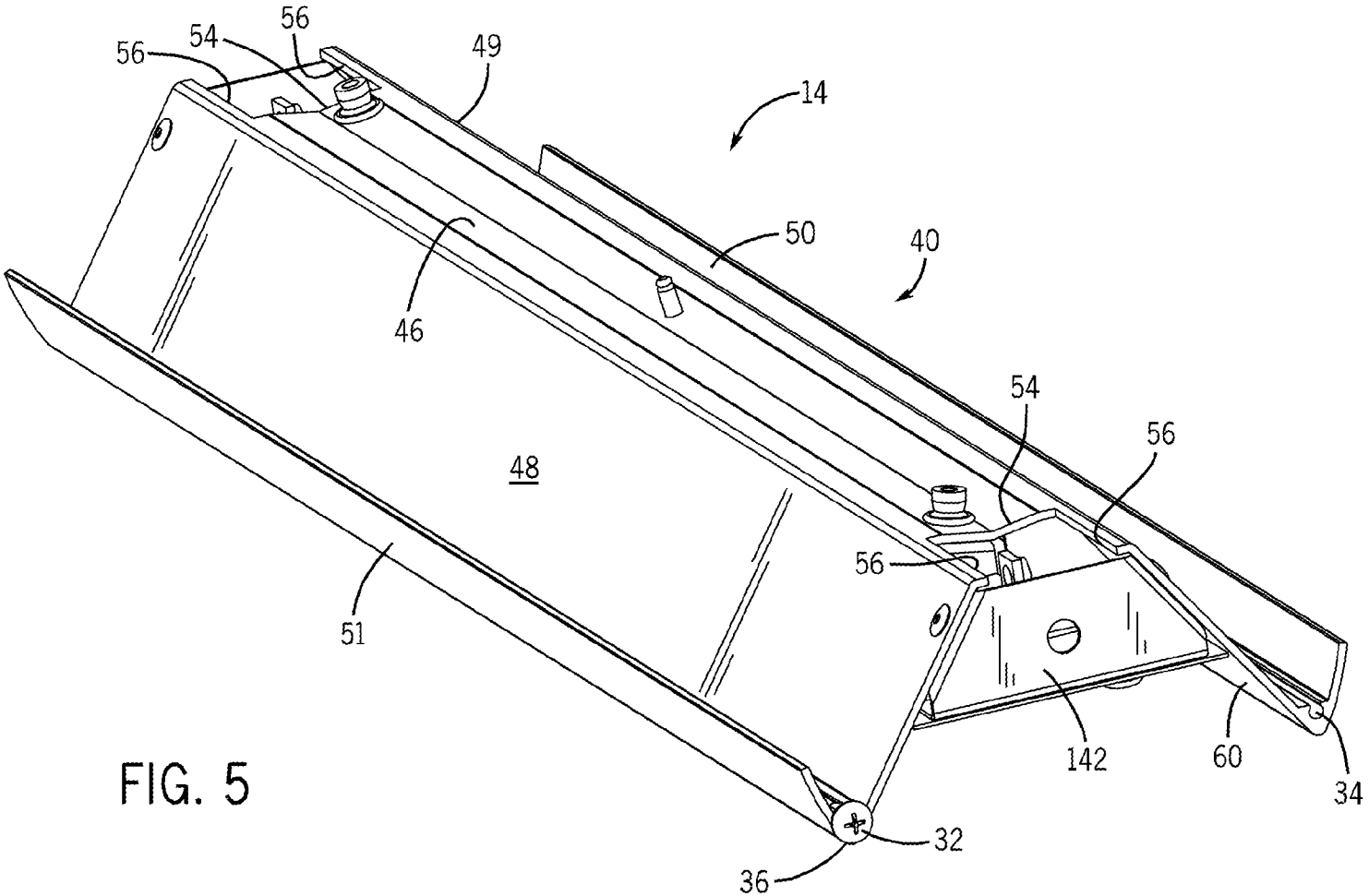
FIG. 5 is an isometric view of the heating unit according to an exemplary embodiment.

As shown in FIGS. 2 and 5, and according to one exemplary embodiment, spine 46 may be further configured to support connectors 42. Spine 46 may include two opposite axial end openings 54 forming edges 56. Openings 54 receive connectors 42 with edges 56 being press fit into corresponding recesses 58 formed on connectors 42 to secure and retain connectors 42 relative to spine 46. Accidental dislodgement of connectors 42 from spine 46 is prevented by ends 20 and 22 which cooperate with spine 46 to limit axial movement of connectors 42. This arrangement enables connectors 42 to be quickly and easily assembled to reflector 40 without the need for additional fasteners or tools. In other embodiments, spine 46 may alternatively include protuberances, flanges or projections in lieu of openings 54 wherein the projections extend into corresponding openings of connectors 42. In still other embodiments, connectors 42 may include protuberances, flanges or projections which extend into corresponding recesses formed on spine 46. In still other embodiments, connectors 42 may be secured to spine 46 by fasteners or other attachment mechanisms.

Figure 6:
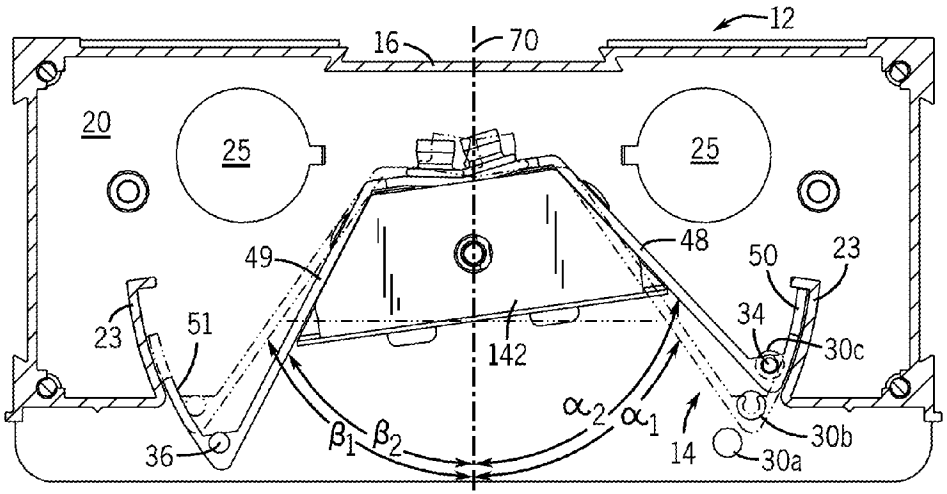
FIGS. 6 and 7 are cross-sections of the heater in FIG. 1 taken along line 6-6 and 7-7 showing the heating unit in various orientations.
Figure 7:
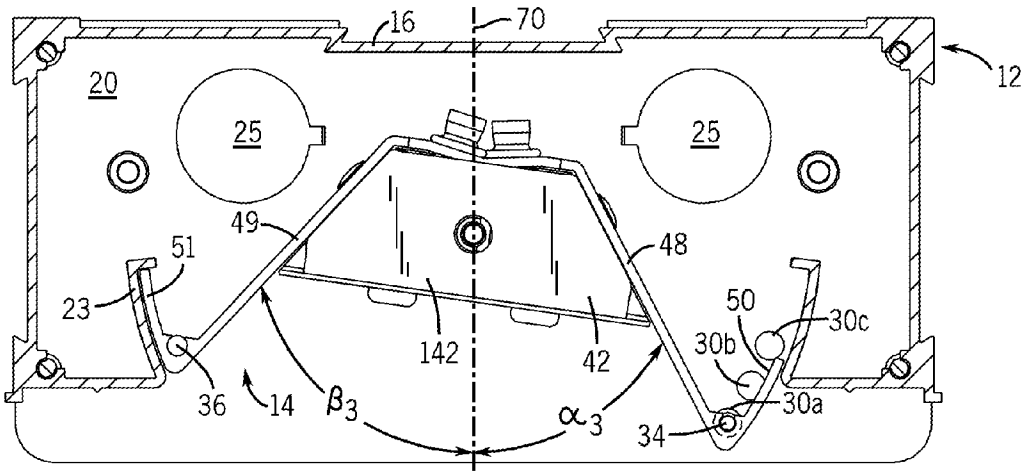

FIGS. 6 and 7 are cross-sectional views of assembled heater 10 (omitting electrical wiring) illustrating heating unit 14 in three distinct positions relative to housing 12. FIG. 6 illustrates heating unit 14 with reflector 40 in a neutral position (shown in dashed lines) in which wings 48 and 49 are equally angularly spaced from a vertical plane 70 extending along the axis of heating element 44. In the particular embodiment illustrated, heat reflecting surfaces 60 of wings 48 and 49 are angularly spaced from plane 70 by angles $\alpha_1$ and $\beta_1$, respectively, and nominally between about 30 degrees and about 40 degrees, and preferably about 35 degrees. Heating unit 14 is retained in the neutral position by retainers 32. Retainers 32 extend through ends 20, 22 into axial retaining engagement with bores 34 and 36. For purposes of illustration, end 22 is not shown. As shown by FIG. 6, bores 34 and 36 are only partially circumscribed, enabling wingtips 50 and 51 to flex relative to wings 48 and 49, respectively. Moreover, bores 34 and 36 have a uniform cross-section along an entire axial length of reflector 40, enabling bores 34 and 36 to be formed as part of an extruded reflector 40. Bores 28 of main body 16 are formed in a similar fashion, eliminating the need for further drilling or removal of material from main body 16 to form bores 28.

FIG. 6 also illustrates heating unit 14 in a first angled position relative to housing 12 in which reflecting surfaces 60 of wings 48 and 49 extend at distinct angles relative to plane 70. According to an exemplary embodiment, surface 60 of wing 48 is at an angle $\alpha_2$ of between about 38 degrees and about 48 degrees from plane 70, while reflector surface 60 of wing 49 extends at an angle $\beta_2$ of between about 22 degrees and about 32 degrees from plane 70. In the example shown, surface 60 of wing 48 is at an angle $\alpha_2$ of about 43 degrees from plane 70, while reflector surface 60 of wing 49 extends at an angle $\beta_2$ of about 27 degrees from plane 70. As a result, more heat emitted by heating element 44 (shown in FIGS. 2-4) is reflected and directed to the right of plane 70 than when reflector 40 is in the neutral position.

Heating unit 14 is retained in the first angular position shown in FIG. 6 by retainers 32. Retainers 32 extend through ends 20 and 22 into axially retaining engagement with bores 34 or 36. In the first angular position shown, bores 34 or 36 are in axial alignment with openings 30*b* of ends 20 and 22. Retainers 32 pass through openings 30*b* and into bores 34 or 36. Heads of retainers 32 bear against ends 20 and 22 so as to retain heating unit 14 relative to ends 20, 22 and the remainder of housing 12.

FIG. 7 illustrates heating unit 14 in a second angular position (i.e., and a third illustrated position) relative to housing 12 in which reflector surface 60 of wing 48 is angularly spaced from plane 70 by an angle $\alpha_3$ and in which reflector surface 60 of wing 49 is angularly spaced from plane 70 by a distinct angle $\beta_3$. According to an exemplary embodiment, angle $\alpha_3$ is between about 22 degrees and about 32 degrees and angle $\beta_3$ is between about 38 degrees and about 48 degrees. In the particular embodiment shown, angle $\alpha_3$ is about 27 degrees and angle $\beta_3$ is about 43 degrees. In other embodiments, reflector surface 60 of wing 48 and 49 may be supported at other distinct angles relative to plane 70.

When in the second angular position shown in FIG. 7, bores 34 or 36 are in axial alignment with openings 30*c* of ends 20 and 22. Retainers 32 extend through openings 30*c* of ends 20 and 22 into axially retaining engagement with bores 34 or 36. Retainers 32 have heads which bear against ends 20 and 22 so as to retain heating unit 14 relative to ends 20 and 22 of housing 12. At the same time, retainers 32 also support heating unit 14 within housing 12. In other embodiments, openings 30*c* may alternatively be configured to support and retain reflector surface 60 of wings 48 and 49 at other angles with respect to plane 70.

Figure 8:
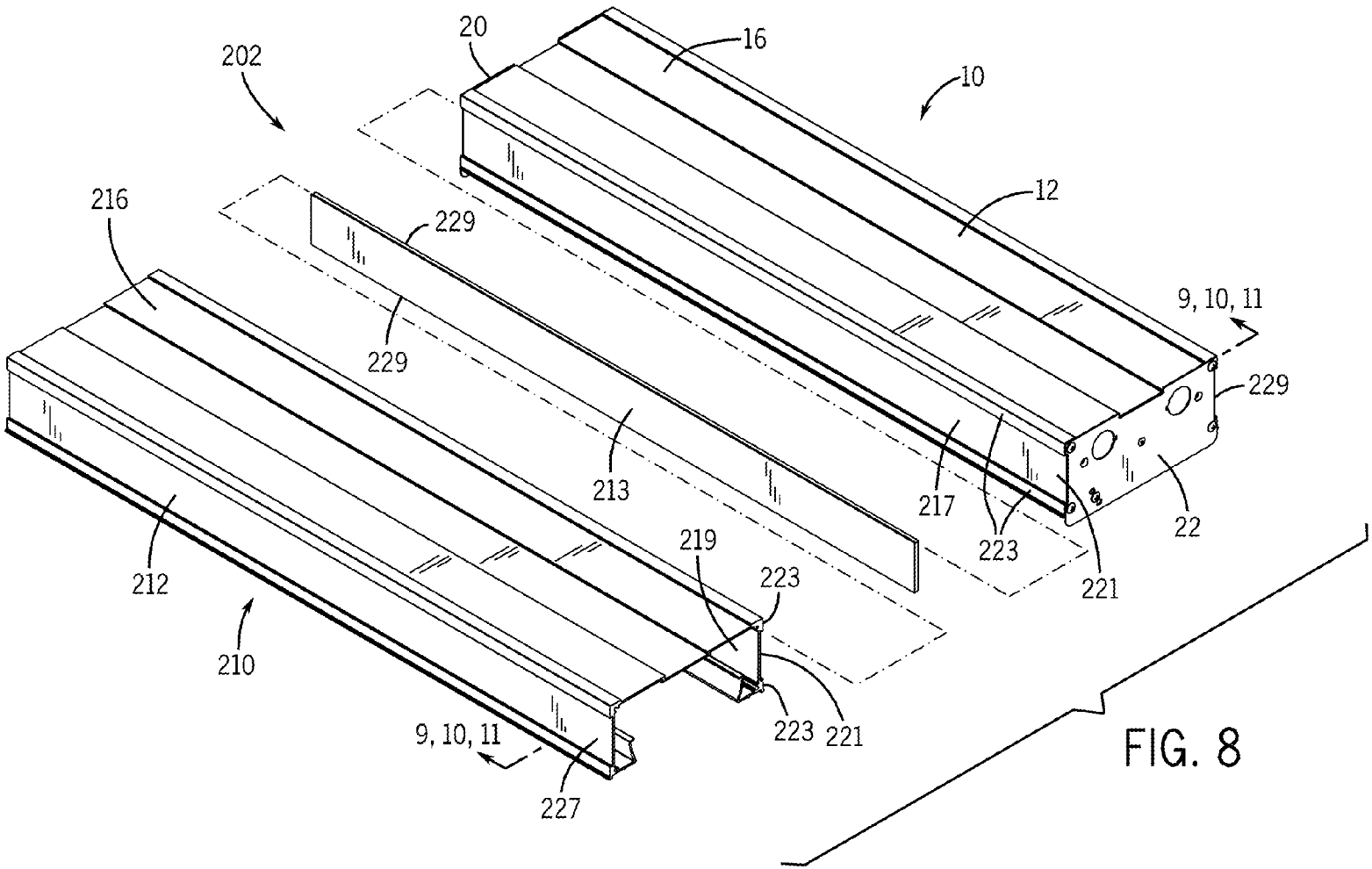
FIG. 8 is an exploded view of a multi-device according to an exemplary embodiment including a heater and a second device coupled with a joiner.

FIG. 8 illustrate a multi-device 202 configuration or arrangement that includes a first device (heater 10), a supplemental or extension device 210 and joiner 213. Extension device 210 comprises a device releasably attachable to heater 10 by joiner 213 and configured to perform a function along an end of heater 10 and/or along a side of heater 10. Device 210 includes housing 212 and a functional unit. Housing 212 comprises a structure configured to be releasably mounted to housing 12 of heater 10. Housing 212 includes a body 216 which forms a majority of housing 212. Body 216 of device 210 and body 16 of heater 10 simultaneously engage and connect to joiner 213. Bodies 16 and 216 include sidewalls 217 and 219, respectively, which face one another when heater 10 and device 210 are positioned side-by-side. Sidewalls 217 and 219 each include an elongate channel 221 bordered by opposing projections 223. As will be described in greater detail, channels 221 and projections 223 facilitate releasable locking of heater 10 and device 210 in a side-by-side arrangement, an end-to-end combination or a combination thereof. Channels 221 simultaneously receive portions of joiner 213 while projections 223 cooperate with one another to releasably lock their respective bodies 16, 216 to joiner 213.

In the particular embodiment shown, body 216 and housing 212 are substantially identical to housing 12 and body 16 of heater 10. Bodies 16 and 216 additionally include channels 221 and projections 223 on opposite sidewalls 225 and 227, respectively. As a result, additional heaters 10 or device 210 may further be connected, enabling any desired length or width of heaters 10 or extension devices 210 to be formed. In other embodiments, body 216 may be different from body 16 and/or only one pair of opposing sidewalls may be provided with channels 221 and projections 223.

According to one embodiment, device 210 is substantially identical to heater 10 such that the combination of heater 10 and device 210 emit heat over a larger area. In another embodiment, device 210 is different from heater 10 but is configured to emit heat. In still another embodiment, device 210 is configured to emit no or a de minimis amount of heat, but emits light. For example, device 210 may comprise a halogen light tube. In still another embodiment, device 210 may emit neither heat nor light and housing 212 serves as an extending hood or shield from heater 10.

Figure 10:
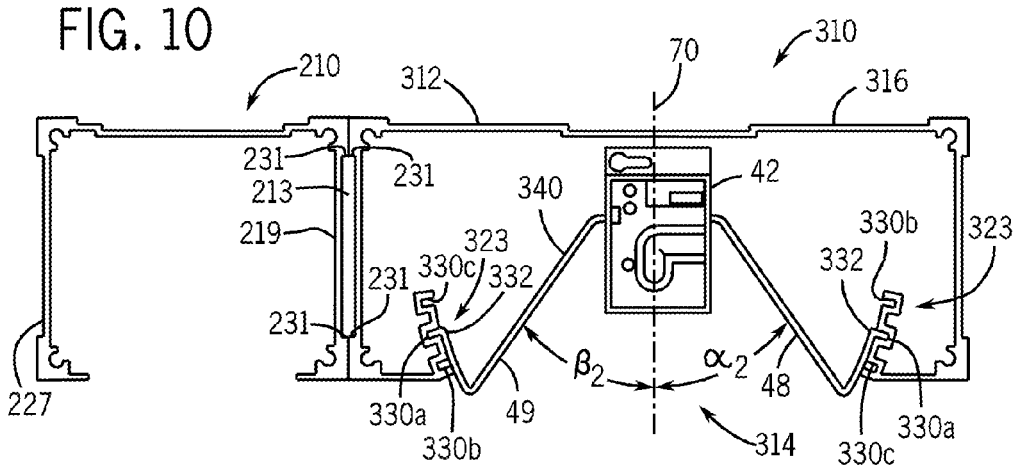
Figure 11:
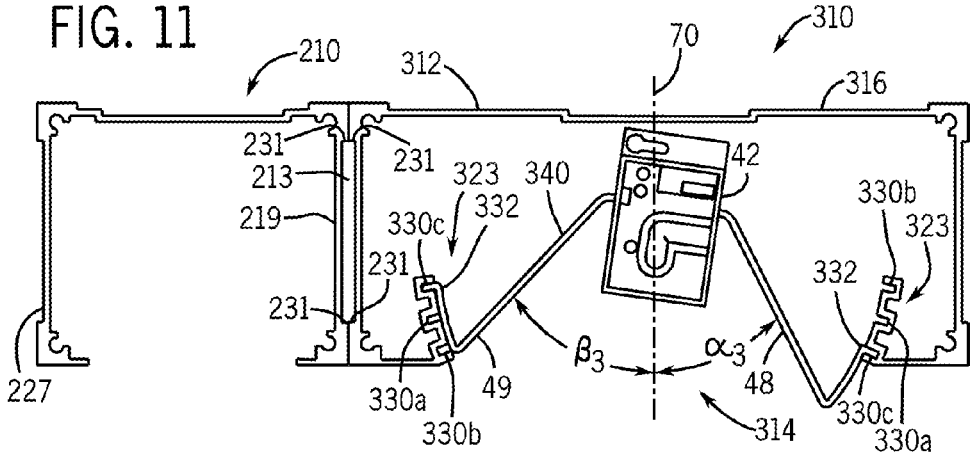
Figure 12:
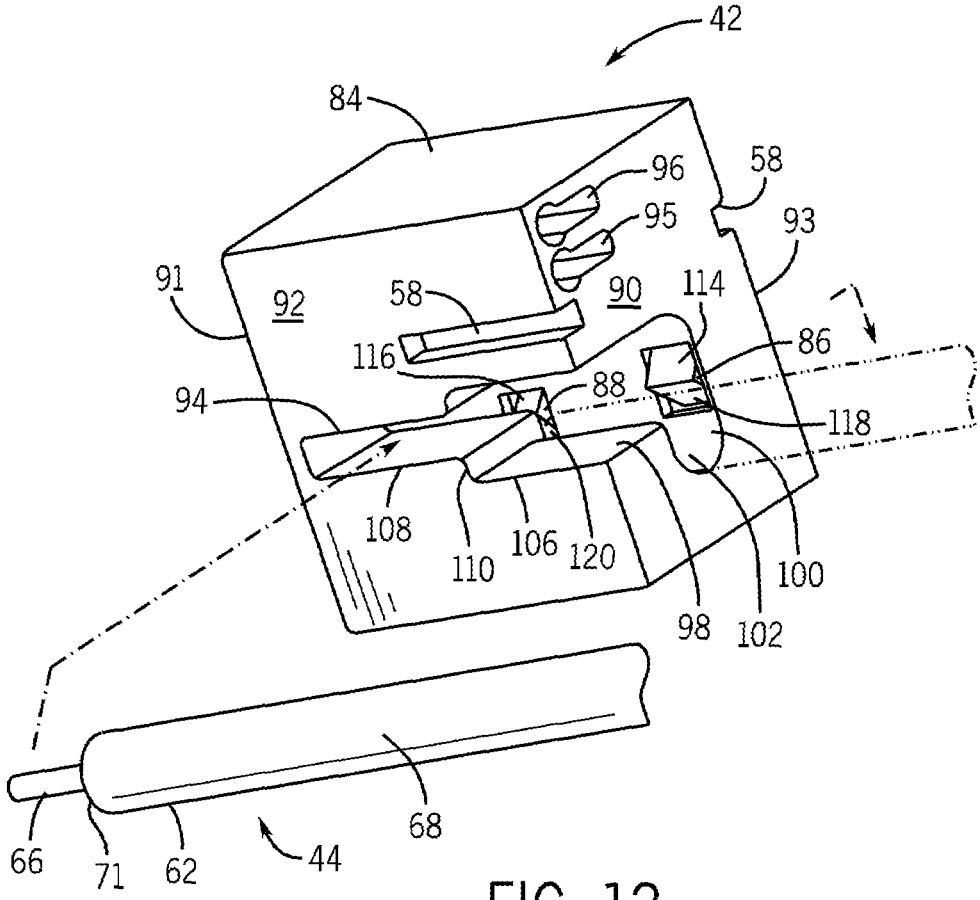
FIG. 12 is an isometric view of the connector in FIGS. 9-11.

Joiner 213 releasably connects heater 10 and device 210 in either or both of side-by-side fashion (as shown by FIGS. 8, 10, 11, and 12) or an end-to-end fashion (not shown). Joiner 213 includes two elongate grooves 229 extending along opposite edges of joiner 213. Grooves 229 are configured to simultaneously receive and engage projections 223 of both body 16 and body 216. As seen in FIGS. 10-12, tips 231 extend into channels 221 of body 16 and 216 adjacent to projections 223 to further interlock body 16 and 216. In the particular embodiment illustrated, grooves 223 are V-shaped while projections 223 are pointed and are received within each V-shaped groove. In other embodiments, channel 221, projections 223, and grooves 229 may have other configurations and may be switched relative to their locations on body 16, body 216 and joiner 213.

In the particular embodiment, joiner 213 is an elongate planar band or strip having a uniform or consistent cross section. As a result, joiner 213 may be extruded. In addition, joiner 213 may be easily slid along one or more of channels 221, enabling joiner 213 to be easily repositioned relative to body 16 or body 216 for end-to-end connections or for side-by-side connections. Because joiner 213 is generally planar, joiner 213 also occupies minimal space, allowing body 16 and body 216 to be joined and abutted to one another such that joiner 213 is hidden and such that multi-device system 202 is more compact. In other embodiments, joiner 213 may have non-uniform cross sectional shapes or may be configured to be relatively immovable in an axial direction relative to body 16 or body 216 when coupled to body 16 or body 216.

Figure 9:
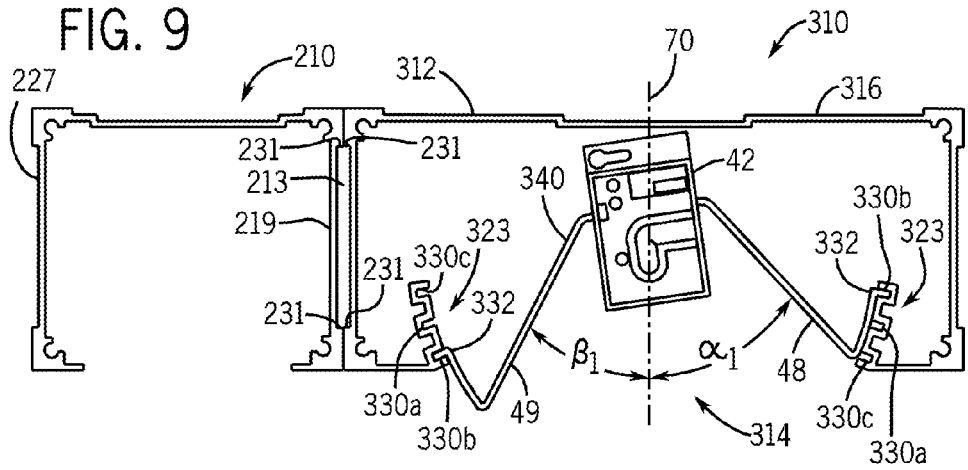
FIGS. 9, 10 and 11 are cross-sections of the multi-device in FIG. 8 taken along line 9-9, 10-10, and 11-11 showing the heating unit in various orientations.

FIGS. 9-11 illustrate heater 310, another embodiment of heater 10, joined to device 210 by joiner 213. Heater 310 includes housing 312 and heating unit 314. Housing 312 includes body 316 and ends (not shown). Body 316 is identical to body 16 except that body 316 includes flanges 323 in lieu of flanges 23. Flanges 323 axially extend along the length of body 316 opposite to one another. Flanges 323 include grooves 330*a*, 330*b* and 330*c*. Grooves 330*a*, 330*b* and 330*c* are configured to slidably receive portions of heating unit 314 to support and retain heating unit 314 in one of selected positions relative to plane 70. Because grooves 330*a*, 330*b* and 330*c* extend in a longitudinal direction along the entire axial length of body 316, body 316 has a uniform cross sectional shape along its entire axial length, enabling body 316 to be extruded.

Although not shown, the ends of housing 312 are substantially identical to ends 20, 22 of housing 12 except that the ends of housing 312 omit openings 30*a*, 30*b* and 30*c*.

Heating unit 314 is substantially similar to heating unit 14 except that heating unit 314 includes reflector 340 in lieu of reflector 40. Reflector 340 is, itself, similar to reflector 40 except that reflector 340 includes tongues 332. Tongues 332 extend from tips 50 and are configured to be slidably received within one pair of grooves 330*a*, 330*b* and 330*c* to retain and orient reflector 340 and heating unit 314 relative to plane 70. In the particular embodiment shown, tongues 332 extend along an entire axial length of reflector 340 such that reflector 340 has a uniform cross section and may be extruded. In alternative embodiments, tongues 332, as well as grooves 330*a*, 330*b* and 330*c* may only extend partially along the axial length of reflector 340 and body 316 or may include a plurality of spaced segments along the axial length of reflector 340 and body 316.

FIG. 10 illustrates tongues 332 resting within grooves 330*a*. As a result, reflector 340 is retained in a neutral position in which the interior surface of wing 48 is angularly spaced from plane 70 by angle $\alpha_1$ and wherein the interior reflecting surface of wing 49 is angularly spaced from plane 70 by angle $\beta_1$. According to an exemplary embodiment, $\alpha_1$ is between about 30 degrees and about 40 degrees while angle $\beta_1$ is between about 30 degrees and about 40 degrees. In this particular embodiment, angle $\alpha_1$ is approximately 35 degrees while angle $\beta_1$ is approximately 35 degrees. FIG. 9 illustrates heating unit 314 supported in an offset position in which tongues 332 are received and resting within grooves 330*b*. In the offset position shown in FIG. 9, heat emitted by heating element 44 is generally directed to the right (as seen in FIG. 9). Tongues 332 engage grooves 330*b* to retain heating unit 314 in place such that the interior surface of wing 48 is angularly spaced from plane 70 by an angle $\alpha_2$ while interior surface of wing 49 is angularly spaced from plane 70 by an angle $\beta_2$. In one preferred embodiment, angle $\alpha_2$ is between about 38 degrees and 48 degrees while angle $\beta_2$ is between about 22 degrees and 32 degrees. In a particularly preferred embodiment, angle $\alpha_2$ is 43 degrees while angle $\beta_2$ is approximately 27 degrees.

FIG. 11 illustrates heating unit 314 retained in another offset position relative to housing 312. In the offset position shown, heating unit 314 is tilted relative to housing 312 so as to direct heat to the left (as seen in FIG. 11). Heating unit 314 is retained in the offset position shown by tongues 332 which are received and rest within grooves 330*c*. The inner surface of wing 48 is angularly spaced from plane 70 by an angle $\alpha_3$ while the inner reflecting surface of wing 49 is angularly spaced from plane 70 by an angle $\beta_3$. In one preferred embodiment, angle $\alpha_3$ is between about 22 degrees and about 32 degrees while angle $\beta_3$ is between about 38 degrees and 48 degrees. In a particularly preferred embodiment, angle $\alpha_3$ is approximately 27 degrees while angle $\beta_3$ is approximately 43 degrees.

Tongues 332 and grooves 330*a*, 330*b* and 330*c* enable the orientation of heating unit 314 to be quickly and easily adjusted. In particular, an individual simply needs to remove one of the ends of body 316. Thereafter, the individual simply needs to axially pull heating unit 314 to remove tongues 332 from grooves 330*a*, 330*b* and 330*c* and then reposition tongues 332 in another of grooves 330*a*, 330*b*, 330*c* at the desired orientation. Lastly, the user replaces the removed end. As a result, the orientation of reflector 340 and of heating unit 314 may be changed without requiring disassembly of heating unit 314. Moreover, because tongues 332 comprise edges of reflector 340 which are received within one of grooves 330*a*, 330*b*, 330*c*, reflector 340 is retained in place without the need for fasteners extending into reflector 340 and without the need for fasteners extending through wings 48, 49 or through the reflecting surfaces 60 of wings 48, 49.

In other embodiments, grooves 330*a*, 330*b*, 330*c* may only be formed along one end of flanges 323, enabling tongues 332 to be removed from such grooves with much less required axial movement of heating unit 314. In particular embodiments, this may be beneficial in that it may allow tongues 332 to be separated from grooves 330*a*, 330*b*, 330*c* without disconnecting wires connected to heating unit 314. In still other embodiments, flanges 323 may omit grooves 330*a*, 330*b* and 330*c*, wherein such grooves 330*a*, 330*b* and 330*c* are alternatively formed upon one or both of the interior opposite axial faces of the ends of housing 312. In such an alternative embodiment, the axial edges of flange 323 or of wings 48, 49 are received within these alternative grooves 330*a*, 330*b*, 330*c* to retain heating unit 314 in a desired orientation relative to housing 312. Although heater 312 is illustrated as including three sets of grooves providing three potential orientations, heater 312 may alternatively include a greater or fewer number of such grooves or otherwise configured detents to provide greater or fewer potential orientations of heating unit 314. In alternative embodiments, grooves 330*a*, 330*b*, 330*c* may alternatively be replaced with projections while tongues 332 may be replaced with grooves or detents, wherein the detents receive one of the selected projections to retain heating unit 314 in a desired orientation.

FIG. 12 (as well as FIGS. 9-11) show a connectors 42 according to an alternative embodiment to connector 142 shown in FIGS. 2-7. Connectors 42 are coupled to opposite axial ends of spine 46 of reflector 40. Connectors 42 comprise structures configured to support heating element 44 such that heating element 44 is partially surrounded by reflective surface 60 provided by spine 46 and wings 48, 49. In the embodiment shown, connectors 42 are supported solely by reflector 40 such that connectors 42 are part of heating unit 14 which may be separated by housing 12 and such that, in embodiments wherein heating unit 14 moves between different positions relative to housing 12, connectors 42 also move with heating unit 14. As will be described in greater detail hereafter, in one particular embodiment, connectors 42 are configured to removably receive end portions of heating element 44 while electrically connecting the end portions to both a power source and to ground. As a result, heating element 44 may be quickly and easily removed from heating unit 14 and from heater 10 for repair, replacement or inspection.

Connector 42 removably receives an end portion of heating element 44 while electrically connecting heating element 44 to both a power source and ground. Connector 42 generally includes body 84 and electrical contacts 86, 88. Body 84 comprises a structure configured to be removably connected to an end portion of heating element 44. Body 84 is configured so as to be highly thermally insulative. In one embodiment, body 84 is formed from a ceramic material. Because connector 42 is formed from ceramic material, connector 42 is extremely compact, reducing the axial length of heater 10 on opposite ends of heating element 44. As result, a greater percentage of the axial length of heater 10 may be used for heating. In addition, because body 84 is formed from a ceramic material, body 84 is also dielectric, enabling active electrical lead 88 and the electrically active portions of heating element 44 to be placed in contact with body 84 without the need for additional insulating structures. In other embodiments, however, body 84 may be formed from other insulative and dielectric materials or may be formed from electrically conductive materials or more thermally conductive materials, wherein additional thermally and electrically insulating materials are utilized.

Body 84 receives and supports an end portion of heating element 44 and includes front face 90, rear face 91, side faces 92, 93, opening or slot 94 and wire openings 95, 96. Slot 94 is formed by body 84 and is configured to removably receive an end portion of heating element 44. Slot 94 extends in one or more directions non-parallel to axis of heating element 44. As result, slot 94 enables an end portion of heating element 44 to be slid into slot 94 from a side, top or bottom of connector 42.

In the particular embodiment illustrated, slot 94 provides a generally sideways L-shaped passage having an entrance portion 98 and a retaining portion 100. Entrance portion 98 extends in a non-vertical direction from a side of body 84, enabling an end portion of heating element 44 to be inserted from a side of body 84. Retaining portion 100 communicates with entrance portion 98 and extends in a non-horizontal direction from entrance portion 98. Retaining portion 100 includes a floor 102 upon which portions of heating element 44 rest. Because retaining portion 100 extends in a non-horizontal direction, retaining portion 100 utilizes gravity to assist in retaining heating element 44 in position against floor 102. Floor 102 is configured to locate an end portion of heating element 44 and to prevent horizontal movement of heating element 44. In the particular embodiment illustrated, floor 102 has a generally semi-cylindrical shape.

Although entrance portion 98 is illustrated as being horizontal while retaining portion 100 is illustrated as being vertical, portion 98 may alternatively extend at other angles between horizontal and vertical and retaining portion 100 may extend at other angles between horizontal and vertical. Although slot 94 is illustrated as having a sideways L-shape, slot 94 may alternatively be substantially linear while extending from a side or top of body 84. In other embodiments, slot 94 may have other configurations. For example, although slot 94 is illustrated as having a single bend, slot 94 may include a fewer or greater number of such bends.

Slot 94 includes a wide portion 106 and a narrow portion 108 separated by a shoulder 110. Wide portion 106, narrow portion 108 and shoulder 110 extend along substantially the entirety of slot 94 in both entrance portion 98 and retaining portion 100. Wide portion 106 is proximate to an axial front face of body 84 and opens from front face 90 toward rear face 90. Wide portion 106 is configured to receive outer portion 68 of heating element 44 such that shoulder 71 of heating element 44 is proximate to and nominally abuts shoulder 110 of slot 94.

Narrow portion 108 extends from wide portion 106 toward rear face 91 of body 84. Narrow portion 108 is configured to receive rod 66 of heating element 44. Wide portion 106, narrow portion 108 and shoulder 110 cooperate to guide the insertion and positioning of end portion 62 (or alternatively end portion 64) of heating element 44 in body 84 and into connection with electrical contacts 86 and 88.

Openings 95 and 96 extend through front face 90 of body 84 and are configured to permit the passage of electrical wiring through front face 90 of body 84. Opening 95 is configured to permit electrical wiring and power source to pass through face 90 of body 84 so as to be electrically coupled to electrical contact 88. Opening 96 enables electrical wiring to further pass through face 90 of body 84 and to extend between housing 12 and reflector 40 to electrical contact 88 of the opposite axial connector 42. Although both of connectors 42 include openings 95 and 96 for ease of manufacture, in other embodiments, only one of connectors 42 may be provided with openings 95 and 96. In still other embodiments, openings 95 and 96 may be omitted where alternative routing of wiring or power is provided.

Electrical contacts 86 and 88 comprise electrically conductive structures coupled to body 84 and configured to be in electrically conductive contact with distinct portions of heater element 44 within slot 94. In particular, electrically conductive contact 86 extends along retaining portion 100 and wide portion 106 of slot 94 so as to contact outer portion 68 of element 44 when end portion 62 (or end portion 64 for the other connector 42) is resting against floor 102. Electrical contact 86 is electrically coupled to ground so as to ground heater element 44.

Electrical contact 88 extends along retaining portion 100 and along narrow portion 108 of slot 94. Contact 88 is configured to electrically contact a circumferential portion of rod 66 when end portion 62 (over end portion 64) is located within retaining portion 100 and resting along floor 102. Contact 88 is electrically coupled to a power source and to rod 66 of heater element 44.

In the particular embodiment illustrated, electrical contacts 86 and 88 each comprise electrically conductive and resilient springs configured to assist in retaining end portion 62 (or end portion 64) in retaining portion 100 against floor 102. Contact portions 86 and 88 have fixed portions, resiliently flexible portions, upper engagement surfaces 114, 116 and lower engagement surfaces 118, 120, respectively. Fixed portions are fixed to body 84 and coupled contacts 86 and 88 to body 84. Resiliently flexible portions comprise spring like portions configured to resiliently flex which extend between fixed portions and engagement surfaces 114, 116, 118 and 120, respectively. Upper engagement surface 114 and lower engagement surface 118 of contact 86 project into wide portion 106 adjacent retaining portion 100. Upper engagement surface 116 and lower engagement surface 120 project into narrow portion 108 of retaining portion 100. Engagement surfaces 114, 116, 118 and 120 are resiliently held within slot 94 by resilient portions. During insertion of end portion 62 or end portion 64 of heater element 44, rod 66 exerts a force against engagement surface 116 and outer portion 68 extends a force against engagement surface 114 to bias resiliently flexible portions to move engagement surfaces 114 and 116 away from the center of slot 94, enabling rod 66 and outer portion 68 of heater element 44 to pass contacts 86 and 88 as they are further moved towards floor 102. Once rod 66 and outer portion 68 have moved past surfaces 116 and 114 towards floor 102, engagement surfaces 118 and 120 are biased back towards a center of slot 94. The sloped surfaces of the sloped nature of surfaces 118 and 120 resiliently urge rod 66 and outer portion 68 against floor 102 of retaining portion 100 to resiliently retain end portion 62 or end portion 64 in position and in electrical contact with both of contacts 86 and 88. At the same time, the resilient nature of contacts 86 and 88 enables ends 62 and 64 of heater element 44 to be easily withdrawn from slots 94 without tools for repair or replacement of heater element 44. In addition to retaining end portions 62 and 64 of heater element 44 in place, the resiliently supported engagement surfaces 114, 116, 118 and 120 provide a person with a clear indication of when end portions 62 and 64 of heater element 44 have been fully inserted and positioned into slot 94 within retaining portion 100.

In other embodiments, electrical contacts 86 and 88 may have other configurations. For example, in other embodiments, only one of contacts 86 and 88 may have resiliently supported engagement surfaces to resiliently retain an end portion 62 or 64 of heater element 44 in place. The other of the electrical contacts 86 or 88 not resiliently supported may alternatively comprise any electrically conductive surface extending along slot 94 so as to contact its corresponding portion of heater element 44 (rod 66 or outer portion 68). In still other embodiments, both electrical contacts 86 and 88 may have non-resiliently supported surfaces that contact rod 66 and outer portion 68 of heater element 44. In such applications, a separate resiliently flexible member coupled to body 84 may be provided and configured to resiliently retain end portions 62, 64 within slot 94. Such additional resilient spring like members may be attached or bonded to body 84 or may be integrally formed as part of a single body with body 84. In still other embodiments, such resilient heater element engaging surfaces may be omitted.

To insert heating element 44 into connector 42, rod 66 is aligned with narrow portion 106, shoulder 71 is aligned with shoulder 110 and outer portion 68 is aligned with wide portion 106 along entrance portion 98 of slot 94. End portions 62 and 64 are then moved into entrance portion 98 of slot 94 until end portions 62 and 64 reach the intersection of entrance portion 98 and retaining portion 100. Thereafter, end portions 62 and 64 of heater element 44 are moved and forced in a direction towards floor 102 until passing engagement surfaces 114, 116, 118 and 120. Shoulder 110 faces shoulder 71 of end portions 62 and 64 of heater element 44 to limit axial insertion of end portions 62 and 64 and to prevent contact between electrical contact 88 and outer portion 68. As described above, lower engagement surfaces 118 and 120 resiliently bear against outer portion 68 and rod 66, respectively, to resiliently urge and retain end portions 62 and 64 against floor 102.

Overall, heaters 10 and 310 provide several beneficial features. Heaters 10 and 310 enable heating units 14 and 314 to be reoriented relative to housings 12 and 312 without the need for fasteners extending through those portions of the heater units 12 and 312 that reflect heat. Each heating unit 14, 314 comprises a distinct unit that may be preassembled and separately inventoried. Moreover, connectors 42 are easily mounted to reflectors 40, 340 without the need for tools. At the same time, connectors 42 enable heating elements 44 to be quickly and easily replaced or removed. In the particular embodiment shown, heaters 10 and 310 are formed from components that are extruded, reducing the overall manufacturing cost. In addition, heaters 10 and 310 may be easily joined to extending devices in an end-to-end fashion or in a side-by-side fashion using joiners 213 to form a multi-device system. In the particular embodiments shown, joiner 213 is configured to connect to heaters or devices while remaining substantially hidden and without increasing the overall size of the system. In sum, multi-device system 202 as well as heaters 10 and 310 offer several advantages over existing heaters. Such advantages are illustrated in the example embodiments as being used in conjunction with one another. In other embodiments, a fewer of such features may be employed together. Examples of various combinations of features illustrated in the above example embodiments are provided in the following definitions.

It is also important to note that the construction and arrangement of the elements of the heater assembly as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. A heater comprising:

a housing;

a reflector; and a pair of opposite connectors supported by the reflector and configured to support opposite ends of a heating element;

a retainer configured to retain the reflector in one of a plurality of positions;

wherein the reflector is movable between the plurality of positions relative to the housing;

wherein the reflector includes an axial bore and wherein the retainer is coupled to the housing and extends into the bore.

2. The heater of claim 1 wherein the retainer is a fastener.

3. The heater of claim 1 wherein the housing comprises a plurality of openings through which the retainer extends to engage the axial bore in one of a plurality of positions that corresponds to the plurality of openings.

4. The heater of claim 3 wherein the plurality of openings comprise spaced apart holes.

5. A heater comprising:

a housing;

a reflector; and a pair of opposite connectors supported by the reflector and configured to support opposite ends of a heating element;

a retainer configured to retain the reflector in one of a plurality of positions;

wherein the reflector is movable between the plurality of positions relative to the housing;

wherein the retainer includes a plurality of axially extending channels, each channel configured to receive the axially extending edge portions of the reflector.

6. The heater of claim 1 wherein the plurality of positions comprises a first position, a second position where the reflector is pivoted at a first angle relative to a vertical plane extending through the heating element, and a third position where the reflector is pivoted at a second angle relative to a vertical plane extending through the heating element.

7. The heater of claim 6 wherein the first angle is between about 27 degrees and about 43 degrees and the second angle is between about 27 degrees and about 43 degrees.

8. The heater of claim 1 wherein the pair of connectors are configured to move with the reflector between the plurality of positions.

9. A heater comprising:

a first housing;

a reflector;

a first connector supported by the reflector and configured to removably receive a first end portion of a heater element while electrically connecting the end portion to both a power source and to ground;

wherein the first connector includes a slot configured to removably receive the first end portion of the heater element wherein the slot is angled.

10. The heater of claim 9 further comprising a second connector configured to removably receive a second end portion of the heater element while electrically connecting the second end portion to both a power source and to ground.

11. The heater of claim 9 wherein the first connector includes at least one electrical contact which resiliently retains the first end portion within the slot.

12. A heater comprising:

a first housing;

a reflector;

a first connector supported by the reflector and configured to removably receive a first end portion of a heater element while electrically connecting the end portion to both a power source and to ground;

wherein the heater element extends along an axis and wherein a slot is configured to receive the first end portion in a direction nonparallel to the axis.

13. The connector of claim 9 wherein the heater element includes an outer portion and an inner rod and wherein the slot includes an internal shoulder between a first portion configured to receive the inner rod and a second portion configured to receive the outer portion.

14. A heater comprising:

a first housing;

a reflector;

a first connector supported by the reflector and configured to removably receive a first end portion of a heater element while electrically connecting the end portion to both a power source and to ground;

wherein the first connector is coupled to the reflector without fasteners.

15. The heater of claim 14 wherein the first connector includes a slot receiving an edge of the reflector to couple the first connector to the reflector.

16. The heater of claim 9 wherein the reflector is movable between a plurality of positions relative to the housing.

17. The heater of claim 16 wherein the first connector is configured to move with the reflector between the plurality of positions.

18. The heater of claim 17 further comprising a retainer configured to retain the reflector in one of the plurality of positions.

19. A heater comprising:

a first housing;

a reflector;

a first connector supported by the reflector and configured to removably receive a first end portion of a heater element while electrically connecting the end portion to both a power source and to ground;

a second housing;

a joiner coupled to the first housing and configured to releasably connect the second housing to the first housing in either a side-by-side fashion or an end-to-end fashion.

20. The heater of claim 19 wherein the first housing includes a first set of opposing projections, wherein the second housing includes a second set of opposing projections and wherein the joiner includes a set of opposing grooves simultaneously receiving the first set of opposing projections and the second set of opposing projections.

21. The heater of claim 19 wherein the joiner is substantially planar.

22. A heater comprising:

a first housing;

a reflector;

a first connector supported by the reflector and configured to removably receive a first end portion of a heater element while electrically connecting the end portion to both a power source and to ground;

wherein the heater element comprises a first portion, a second portion, and a third portion, wherein the first portion and the third portion are configured to provide a first wattage density and the second portion is configured to provide a second wattage density.

23. The heater of claim 22 wherein the first portion and the third portion are the ends of the heating element, and the second portion is the middle of the heating element between the first portion and the third portion.

24. The heater of claim 23 wherein the first wattage density is provided by a wire coil having a first coil density, and the second wattage density is provided by a wire coil having a second coil density that is less than the first coil density.

25. The heater of claim 14 wherein the heater element comprises an electrical resistance tubular heating element.

26. The heater of claim 14 further comprising one or more retaining hooks extending from the reflector and configured to retain and support the heating element.

27. A heater comprising:

a housing;

a reflector movable between a plurality of discrete positions relative to the housing;

a heating element having a first portion configured to provide a first heat energy level and at least one second portion configured to provide a second heat energy level less than the first portion; and a first connector supported by the reflector and configured to removably receive a first end portion of the heater element while electrically connecting the end portion to both a power source and to ground.

28. The heater of claim 27 wherein the reflector includes an axial bore and wherein the retainer extends into the bore through one of a plurality of openings in the housing.

29. The heater of claim 28 wherein the plurality of positions comprises a first position, a second position where the reflector is pivoted at a first angle relative to a vertical plane extending through the heating element, and a third position where the reflector is pivoted at a second angle relative to a vertical plane extending through the heating element.

30. The heater of claim 27 wherein the at least one first portion is the ends of the heating element, and the second portion is the middle of the heating element intermediate the ends of the heating element.

31. The heater of claim 30 wherein the first heat energy level is provided by a wire coil having a first coil density, and the second heat energy level is provided by a wire coil having a second coil density that is less than the first coil density.

* * * * *